United States Patent [19]

Tanaka et al.

[11] Patent Number: 4,496,258

[45] Date of Patent: Jan. 29, 1985

[54] WRITING PEN WITH SPACE BEHIND NIB

[75] Inventors: Isao Tanaka; Takao Inaba, both of Aichi, Japan

[73] Assignee: Pilot Ink Co., Ltd., Aichi, Japan

[21] Appl. No.: 499,026

[22] Filed: Jun. 2, 1983

Related U.S. Application Data

[63] Continuation of Ser. No. 311,356, Oct. 14, 1981, abandoned.

[30] Foreign Application Priority Data

Oct. 17, 1980 [JP] Japan ..... 55/148604[U]

[51] Int. Cl.[3] ..... B43K 8/02; B43K 5/08

[52] U.S. Cl. ..... 401/206; 401/198; 401/199

[58] Field of Search ..... 401/206, 198, 199, 264, 401/265

[56] References Cited

U.S. PATENT DOCUMENTS

| | | | |
|---|---|---|---|
| 591,503 | 10/1897 | Schweinfurth | 401/206 |
| 2,320,823 | 6/1943 | Kingson | 401/206 |
| 3,032,802 | 5/1962 | Kusama | 401/206 |
| 3,113,336 | 12/1963 | Langnickel | 401/206 |
| 3,233,275 | 2/1966 | Hansen et al. | 401/206 |
| 3,520,629 | 7/1970 | Otsuka | 401/265 X |
| 3,589,824 | 6/1971 | Andrews et al. | 401/206 |
| 3,640,631 | 2/1972 | Sotir | 401/206 |
| 3,682,559 | 8/1972 | Hirota | 401/198 X |

FOREIGN PATENT DOCUMENTS

| | | | |
|---|---|---|---|
| 1561793 | 4/1970 | Fed. Rep. of Germany | 401/198 |
| 2264488 | 11/1973 | Fed. Rep. of Germany | 401/199 |
| 2730689 | 1/1979 | Fed. Rep. of Germany | 401/206 |
| 87610 | 9/1966 | France | 401/199 |
| 1484989 | 5/1967 | France | 401/199 |
| 2350970 | 10/1974 | France | 401/265 |
| 7701595 | 8/1978 | Netherlands | 401/199 |

*Primary Examiner*—Steven A. Bratlie

*Attorney, Agent, or Firm*—Sughrue, Mion, Zinn, Macpeak, and Seas

[57] ABSTRACT

A writing pen wherein a valve element is operated to supply a writing nib held in a pen holder with ink from an ink reservoir is disclosed. The pen is characterized by having an ink guide stem between the writing nib and the valve element and a small ink-retaining space that is provided at least between the rear end of the nib and the front end of the ink guide stem.

1 Claim, 9 Drawing Figures

WRITING PEN WITH SPACE BEHIND NIB

This application is a continuation of application Ser. No. 311,356 filed 10/14/81 now abandoned.

FIELD OF THE INVENTION

The present invention relates to a writing pen, and more particularly, to a writing pen wherein a valve plunger is operated to supply a writing nib held in a pen holder with ink from an ink reservoir. Still more particularly, the present invention relates to a writing pen suitable for writing very fine letters which has an ink guide stem between a writing nib and a valve plunger, and a small ink retaining space that is provided at least between the rear end of the nib and the front end of the ink guide stem.

BACKGROUND OF THE INVENTION

Several pen designs have been proposed wherein a valve plunger is operated to supply a writing pen with ink from an ink reservoir, the pen being used to write thick letters with ink which is of relatively high viscosity and has pigment particles dispersed in a solvent. A specific example of such a writing pen is described in U.S. Pat. No. 3,640,631. The primary feature of this prior art pen is the construction of a valve plunger which is used with a highly porous writing nib which easily absorbs ink through both the rear end and side surfaces. This nib may, for example, be a nib of relatively large diameter that is made of fairly loosely bound, resin-treated fiber filaments, or a felt material. But this arrangement cannot be directly used with a durable writing nib having an outer diameter of not more than 3 mm that is suitable for writing fine letters. Such a durable writing nib may, for example, be a synthetic resin nib having an ink passage bored through the axis of the interior of the resin, or a fiber nib comprising a firm combination of longitudinally bound filaments. A nib of this kind has a small capacity for retaining ink and absorbs only a limited amount of ink through its side surface. If the arrangement of U.S. Pat. No. 3,640,631 is directly applied to a fine nib, the small ink retaining capacity of the nib, and the direct supply of ink from an ink reservoir without control by capillary action, cause excessive ink to spill from the pen point.

SUMMARY OF THE INVENTION

It is therefore an object of the present invention to provide a writing pen that can be used with a fine durable writing nib and which has a sustained and consistent ink flow and good durability suitable for writing fine letters.

In accordance with this invention, an ink guide stem is provided between the writing nib and the valve element and a small ink-retaining space is provided at least between the rear end of the nib and the forward end of the guide stem. The stem has a large diameter and is highly porous. The exact configuration of the ink-retaining space can be varied in different embodiments, and a porous cylinder can optionally be fitted over the ink guide stem for absorbing excess ink flow. A closed-end cap can also be placed over the rear end of the guide stem for protection and durability.

BRIEF DESCRIPTION OF THE DRAWINGS

The invention will be more clearly understood from the following description with reference to the accompanying drawings, in which.

DETAILED DESCRIPTION OF THE INVENTION

Figure 1:
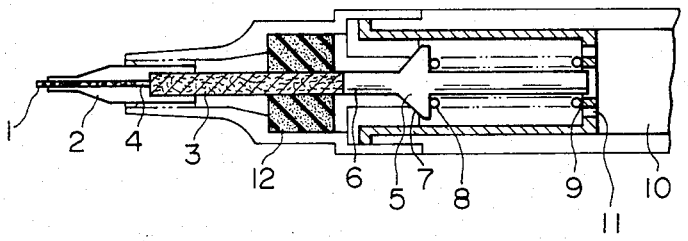
FIG. 1 is a longitudinal sectional view of essential parts of a writing pen according to a first embodiment of this invention.

The present invention provides a writing pen wherein the pen point is supplied with ink from an ink reservoir when a spring-loaded valve plunger is unseated by pressing down the pen point, or by knocking down a knock lever inserted at the rear end of a tubular pen body, or by squeezing a flexible pen casing. The pen is characterized by having an ink guide stem between the writing nib and the valve plunger, and a small ink retaining space is provied at least between the rear end of the nib and the front end of the ink guide stem To achieve sustained writing of fine letters, the writing pen of the present invention uses a nib having an outside diameter of not more than 3 mm, preferably between 0.6 and 2 mm, which is made of a synthetic resin or a firm combination of loosely bound, resin-treated fiber filaments. A synthetic resin nib having an ink passage bored through the axis of the plastic interior is particularly effective, because it permits the shape and size of the inner ink passage to be adjusted freely according to the properties of various ink compositions used, and provides an outer shell having sufficient rigidity and durability to withstand repeated valve openings by pressing down the pen point.

The ink guide stem according to the present invention has suitable capillary action and fluid retention, and it supplements the ink flow to the fine nib to furnish the nib with an ample and consistent supply of ink. During writing operations, the guide stem supplies the small ink retaining space between the rear end of the nib and the stem with a controlled amount of freely running ink from the ink reservoir, and the rear end of the nib is kept in contact with a small amount of the freely running ink. Specifically, the stem is a bar that has a larger diameter and higher porosity than the nib and which is made of a resin-treated fiber material, or foamed resin having open cells, or other porous material. The ink guide stem is positioned behind the writing nib fixed to the holder.

The other requirement of the present invention is an ink retaining small reservoir provided at least between the rear end of the nib and the front end of the ink guide stem. The small ink retaining space separates the writing nib from the ink guide stem. It prevents the rear end of the nib from blocking the ink passage due to contact with the stem, and also prevent the front end of the guide stem from having increased density due to compressive deformation. Another function of the ink retaining space is to temporarily hold the small amount of freely running ink that exceeds the ink retaining capacity of the stem and increase the area of contact of ink with the ink passage at the rear end of the nib. The ink retaining space is small enough to prevent ink spillage from the nib, and its size or capacity is determined by the properties of ink (e.g. viscosity and surface tension) and the fluid retainability of the nib. For example, with highly oozable and flowable ink having low surface tension and viscosity and/or a writing nib having small fluid retention capability, the space is small enough to hold the ink by surface tension, and with less flowable ink and/or a nib having great fluid retention capapbility, the space has larger capacity. The small ink retaining space described above is capable of achieving an efficient supply of ink to a synthetic resin nib, or other nibs having small capillary action, that is provided with an axial ink passage having a larger channel than the capillary tubes formed between fiber filaments to permit the flow of ink of relatively high viscosity such as ink having pigment particles dispersed in a solvent. During writing, the ink in the small ink-retaining space flows out of the pen point, and to compensate for the amount of ink consumption, the ink in the guide stem is supplied to the small ink retaining space for use in continued writing. The amount of the supply of the ink from the ink guide stem depends on its ability to retain fluids and on the properties of ink, but there is an inherent limit to the amount of ink supply, and if this limit exceeded (i.e., when ink supply is interrupted during writing), one can resume writing by repeating the valve-opening procedure to let the ink flow through the nib.

In the second embodiment of the present invention, a writing pen having a porous cylinder fitted over the ink guide stem is provided. The porous cylinder absorbs excess ink flowing out of the ink reservoir upon valve opening and retains the same so that it will not spill from the pen point. The porous cylinder also directs the absorbed ink to the ink guide stem. It is made of a highly porous material such as sponge having open cells of a felt material.

With a writing pen wherein the front face of the valve plunger is pressed with the rear end of the ink guide stem, it is preferred that a short cylinder having a closed end is fitted over the rear end of the ink guide stem. The short cylinder with a closed end reinforces the rear end of the ink guide stem. As described above, the ink guide stem is made of porous material of relatively low strength that absorbs ink and lets it ooze out, so it frequently occurs that the compressive force applied to the valve plunger deforms, softens or collapses the rear edge or rear end surface of the stem, or in some cases, the front end of the valve plunger is thrust into the rear end of the stem. The short cylinder with a closed end is effective to eliminate malfunctions due to these troubles. The short cylinder with a closed end is formed of plastic, metal, or other materials such as a porous material having high strength and low porosity, and its closed end has a circular, polygonal or other cross-section. If necessary, the wall of the cylinder or the closed end has suitable notches, slits or small holes, and alternatively, the inner surface may be provided with grooves or projections to provide minute spaces between the cup-shaped cylinder and the rear end of the stem. This arrangement permits the ink to be supplied around the part of the ink guide stem over which the short cylinder is fitted.

Preferred embodiments of the present invention will now be described in greater detail with reference to the accompanying drawings. A holder generally indicated at 2 has a small-size bore formed in its front end to receive a writing nib 1 which communicates with a large-size bore formed in the rear end to receive an ink guide stem 3, with the two bores being aligned along the same axis of the interior of the holder. A small part of the nib 1 extends out of the front end of the holder, and the greater part of the ink guide stem 3 extends from the rear end of the holder, and both the nib and guide stem are fitted into and fixed in the holder. In the embodiments of FIGS. 1, 3, 4, 5, 6 and 8 where the pen point is pressed down to retract the guide stem 3 to unseat a valve plunger 6, the holder 2 is loosely fitted in the tip of the tubular casing of the pen. In the embodiments of FIGS. 2 and 7 wherein the valve plunger is unseated by snapping a lever fitted on the rear end of the tubular casing or squeezing a flexible tubular casing, the holder 2 is secured to the tip of the tubular casing.

A porous cylinder 12 made of sponge, having a higher porosity (60 to 85%) than the ink guide stem 3, is fitted over the stem. The cylinder 12 absorbs and retains the ink that has oozed from an ink reservoir 10 upon unseating of the valve plunger and thus prevents ink spillage from the tip of the tubular casing, while also supplying ink through the side surface of the stem 3. Needless to say, the stem 3 is supplied directly with ink by unseating the valve plunger.

The ink reservoir 10 is positioned at the rear portion of the tubular casing and communicates with the front portion through an ink conduit 11. A spring seat 9 engages one end of a spring 8 that resiliently supports the back side of a valve element 5. The valve element 5 is held in intimate contact with a valve seat 7 by means of the spring 8 so as to prevent ink leakage when the pen is not used.

Figure 2:
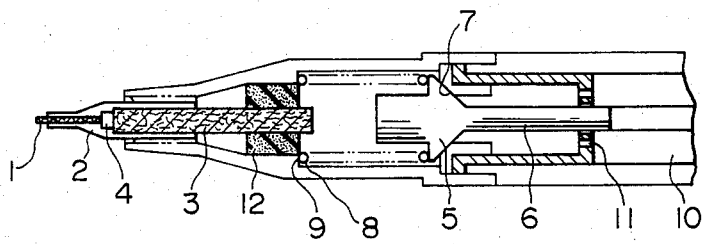
FIG. 2 is a longitudinal sectional view of essential parts of a writing pen according to a second embodiment of this invention.

In the embodiment of FIG. 1, the writing nib 1 has an outside diameter of 1 mm and is made of a synthetic resin having an ink passage bored through the axis of its plastic interior. The ink guide stem 3 is made of a bundle of resin-treated fiber filaments. A small ink-retaining space 4 having a diameter generally equal to the outside diameter of the nib 1 is formed axially within the holder 2 between the rear end of the nib and the front end of the ink guide stem 3.

In the embodiment of FIG. 2, the nib 1 has an outside diameter of 2 mm and is made of a bundle of resin-treated fiber filaments, and the ink guide stem 3 is made of a foamed resin bar having an outside diameter of 4 mm and a porosity of about 50%, and the small ink-retaining space 4 has a cross section larger than the outside diameter of the nib.

Figure 3:
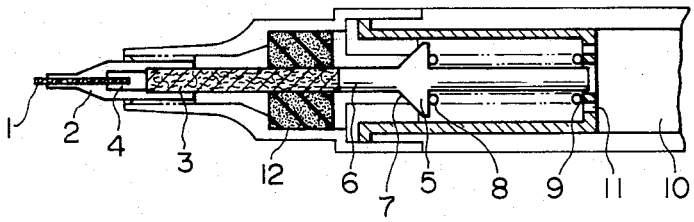
FIG. 3 is a longitudinal sectional view of essential parts of a writing pen according to a third embodiment of this invention.

In the embodiment of FIG. 3, the rear end of a nib 1 having an outside diameter of 1 mm and which is made of a bundle of resin-treated fiber filaments extends into a space within the holder 2. The space has a larger diameter than the outside diameter of the nib so as to form an annular small ink-retaining space 4 in the interior of the holder 2.

Figure 4:
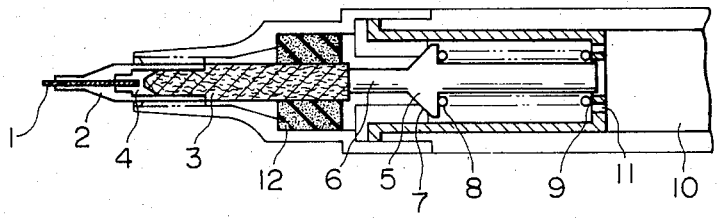
FIG. 4 is a longitudinal sectional view of essential parts of a writing pen according to a fourth embodiment of this invention.

In the embodiment of FIG. 4, a nib 1 having an outside diameter of 3 mm and which is made of a foamed resin having open cells, and a small ink-retaining space 4 having an annular space on both sides is formed between the nib 1 and an ink guide stem 3 tapered toward the front end.

Figure 5:
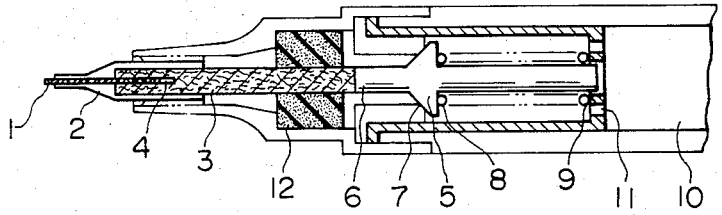
FIG. 5 is a longitudinal sectional view of essential parts of a writing pen according to a fifth embodiment of this invention.
Figure 6:
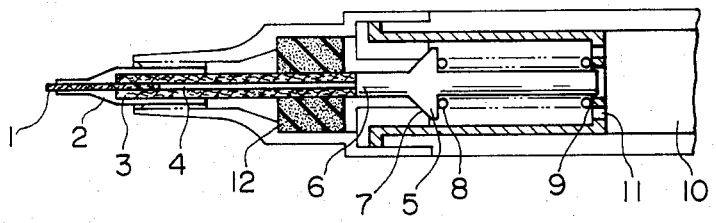
FIG. 6 is a longitudinal sectional view of essential parts of a writing pen according to a sixth embodiment of this invention.
Figure 7:
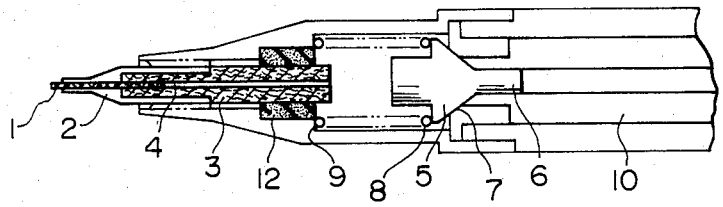
FIG. 7 is a longitudinal sectional view of essential parts of a writing pen according to a seventh embodiment of this invention.

In the embodiments of FIGS. 5 to 7, a small ink-retaining space 4 is formed within an ink guide stem 3 along the axis of the nib. In FIG. 5, the space 4 is formed in the front end of the stem 3, in FIG. 6 the space is formed between the terminating end of the axis of the stem 3 and the front end of the valve plunger 6, and in FIG. 7 the space is formed through the axis of the stem 3. In these embodiments, the nib 1 and stem 3 may be made of various materials and have various sizes as selected from the foregoing embodiments.

Figure 8:
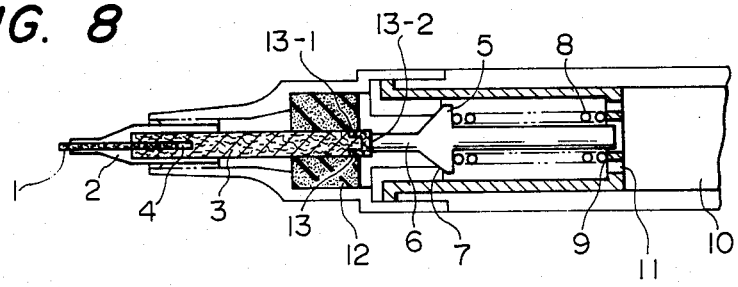
FIG. 8 is a longitudinal sectional view of essential parts of a writing pen according to a eighth embodiment of this invention.

In the embodiment of FIG. 8, a short cylinder with a closed end 13 is fitted over the rear end of the ink guide stem 3 to reinforce the latter. The nib 1 is made of a synthetic resin and has an outside diameter of 1 mm and has an ink passage bored through the axis of its plastic interior. The ink guide stem 3 is a bar having an outside diameter of 3 mm and which is made of a bundle of resin-treated fiber filaments. The stem 3 is provided with an axial recess having an inside diameter generally equal to the outside diameter of the nib 1 and the rear of the nib is fitted into the front part of the recess, thus forming a small ink-retaining space 4 between the rear end of the nib and the closed end of the recess.

Figure 9:
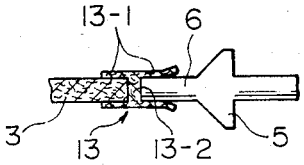
FIG. 9 is a longitudinal sectional view of a modified version of the closed-end cylinder used in FIG. 8.

FIG. 9 is a longitudinal section showing another embodiment of the short cylinder with a closed end 13. In this embodiment, the wall 13-1 of the short cylinder extends to cover not only the stem 3 but also the valve plunger 6 so as to reinforce the rear end of the stem, as well as the front end of the plunger. Such an arrangement provides a guide means that facillitates the connection of the plunger with the stem. The short cylinder with a closed end 13 illustrated in FIGS. 8 and 9 can be fitted over the ink guide stem 3 used in the other embodiments of the present invention.

What is claimed is:

1. A writing pen wherein a valve element is operated to supply a writing nib in a pen holder with ink from an ink reservoir, the improvement comprising:

a holder formed with a small bore in its front end and a large bore in its rear end, said bores in communication with each other and axially aligned;

said writing nib formed of synthetic resin having an outer diameter of not more than 2 mm and having an axially extending ink passage bored through its interior, said small bore supporting said writing nib with the tip thereof protruding therefrom; and an ink guide stem between said writing nib and said valve element, said ink guide stem formed of porous resin-treated fiber material and adapted to receive the ink flowing from said ink reservoir and to supply said ink to said writing nib by capillary action, said large bore supporting said ink guide stem which extends rearward from said holder, said ink guide stem being formed with a recess at its front end, said recess extending in an axial direction of said ink guide stem and having an inner diameter substantially equal to an outer diameter of said writing nib to receive the rear end portion of said writing nib, said recess providing a small ink-retaining space defined between the rear end face of said writing nib and said ink guide stem for temporarily retaining therein a small amount of ink that exceeds the ink retaining capacity of said ink guide stem.

* * * * *